US012557912B1

(12) United States Patent
Pendleton

(10) Patent No.: US 12,557,912 B1
(45) Date of Patent: Feb. 24, 2026

(54) HEIGHT-ADJUSTABLE SEAT

(71) Applicant: Marcus Pendleton, Philadelphia, PA (US)

(72) Inventor: Marcus Pendleton, Philadelphia, PA (US)

( * ) Notice: Subject to any disclaimer, the term of this patent is extended or adjusted under 35 U.S.C. 154(b) by 118 days.

(21) Appl. No.: 18/654,179

(22) Filed: May 3, 2024

Related U.S. Application Data

(60) Provisional application No. 63/463,672, filed on May 3, 2023.

(51) Int. Cl.
*A47C 3/36* (2006.01)
*A47C 4/28* (2006.01)

(52) U.S. Cl.
CPC . *A47C 3/36* (2013.01); *A47C 4/28* (2013.01)

(58) Field of Classification Search
CPC .... A47C 3/36; A47C 4/28; A47B 9/16; D06F 81/04
USPC ..... 108/116, 118, 120; 297/19
See application file for complete search history.

(56) References Cited

U.S. PATENT DOCUMENTS 1,011,585 A * 12/1911 Creasey ..... A47B 87/002 108/78
1,152,987 A * 9/1915 Spalding ..... A47B 3/02 108/118
1,202,660 A * 10/1916 Breault ..... A47B 3/02 108/118
1,422,313 A * 7/1922 Smith ..... A47B 3/0911 108/118
1,426,160 A * 8/1922 Driver ..... A47B 3/02 108/118
1,451,047 A * 4/1923 Mead ..... A47C 4/283 108/118
1,456,840 A * 5/1923 Zsikay ..... A47C 4/38 108/118
1,506,464 A * 8/1924 Alten ..... A47C 4/30 297/320
1,519,078 A * 12/1924 Wester ..... A47C 4/283 108/118
1,835,661 A * 12/1931 Marquardt ..... A47B 3/02 108/118

(Continued)

FOREIGN PATENT DOCUMENTS

CN 208863889 U 5/2019
DE 3213411 A1 * 10/1983

(Continued)

*Primary Examiner* — Jose V Chen
(74) *Attorney, Agent, or Firm* — John Rizvi; John Rizvi, P.A. - The Patent Professor®

(57) ABSTRACT

A height-adjustable seat, which may be used for meditation, is provided that is height adjustable to position a user closer to a floor as the user gains flexibility and position the user further from the floor in case of injury. The height-adjustable seat includes a pivotal frame having a first upper cross bar and a spaced apart second upper cross bar. A sling seat is suspended between the cross bars and is adjustable in width to raise and lower the height of the sling seat relative to the floor. The sling seat includes a free, first end and a fixed, second end. The second end is connected to the second upper cross bar of the frame and the first end is releasably engageable with a lower surface or side of the sling seat.

20 Claims, 6 Drawing Sheets

(56) References Cited

U.S. PATENT DOCUMENTS

| | | | | | |
|---|---|---|---|---|---|
| 3,182,614 | A * | 5/1965 | McLean | A47C 4/38 | 297/26 |
| 4,328,992 | A * | 5/1982 | Ohanian | A47C 16/025 | 108/118 |
| 4,544,203 | A * | 10/1985 | Younger | A47G 9/1009 | 403/348 |
| 4,679,655 | A * | 7/1987 | Behring | A47C 9/10 | 108/118 |
| 4,904,018 | A * | 2/1990 | Young | A47C 9/10 | 297/55 |
| 5,353,715 | A * | 10/1994 | Luyk | A47B 9/16 | 108/119 |
| 5,483,901 | A * | 1/1996 | Tisbo | A47B 3/02 | 248/164 |
| 6,295,987 | B1 * | 10/2001 | Parker | A61G 13/12 | 128/845 |
| 10,206,514 | B1 | 2/2019 | Zivalich | | |
| 10,660,442 | B2 | 5/2020 | Miles | | |
| 2017/0143127 | A1 | 5/2017 | King-O'Connor | | |
| 2021/0282559 | A1 | 9/2021 | Towle | | |

FOREIGN PATENT DOCUMENTS

| | | | |
|---|---|---|---|
| DE | 19716358 | A1 | 10/1998 |
| DE | 202012006208 | U1 | 9/2012 |
| WO | 2017197414 | A1 | 11/2017 |

* cited by examiner

HEIGHT-ADJUSTABLE SEAT

CROSS-REFERENCE TO RELATED APPLICATION

This application claims the benefit of U.S. Provisional Patent Application No. 63/463,672, filed on May 3, 2023, which is incorporated herein by reference in its entirety.

FIELD OF THE INVENTION

The present invention relates generally to meditation seats, and more particularly, to a height-adjustable seat that is adjustable in height for the comfort and convenience of the user.

BACKGROUND OF THE INVENTION

People seek relief from the daily stress of life in a variety of ways such as, for example, exercise, social gatherings, and the like. Many people turn to meditation as a way to relieve stress. Meditation not only relieves stress but can help relieve anxiety, improve blood pressure, and support weight loss, as well as providing a host of other benefits.

In mediation, the goal is to sit comfortably for extended periods of time while maintaining concentration and/or focus on a single or simple thing, such as the breath. In some forms of meditation, the seated posture is preferably performed while seated on a floor. This requires the person to have a great deal of flexibility to avoid getting muscle cramps or sores.

However, many people who wish to start meditating lack the flexibility to sit on the floor for extended periods of time. This may be due to injury or recent surgery or just to a general lack of flexibility. In these cases, people often turn to chairs to begin a meditation practice. As one gains flexibility, lower chairs or stools may be substituted until the person gets as low as they are capable of, hopefully to a position sitting directly on the floor or a shallow pillow. This constant search for the correct height seat disrupts the meditation process and can be a burden in larger meditation groups or "sits".

Accordingly, there is need for a solution to at least one of the aforementioned problems. For instance, there is an established need for a meditation seat that is height adjustable for the comfort and convenience of the user.

SUMMARY OF THE INVENTION

The present invention is directed to a height-adjustable seat that is height adjustable to position a meditation practitioner or other user closer to a floor as the practitioner gains flexibility and position the practitioner further from the floor in case of injury. The height-adjustable seat includes an adjustable frame having a first upper cross bar and a spaced apart second upper cross bar. A sling seat is suspended between the cross bars and is adjustable in width to raise and lower the height of the sling seat relative to the floor. The sling seat includes a free, first end and a fixed, second end. The second end is connected to the second upper cross bar of the frame and the first end is releasably engageable with a lower surface or side of the sling seat.

In an implementation of the invention, an adjustable seat, allowing a user to sit closer to a floor as the user gains flexibility or to otherwise adjust a seating distance of the user with respect to the floor, may include:

a seat frame comprising a first upper cross bar and a second upper cross bar arranged in parallel and spaced-apart relationship with one another, wherein the seat frame is adjustable such that the first upper cross bar and the second upper cross bar are selectively positionable in a plurality of different height adjustments with respect to the floor and at which the first and second upper cross bars are arranged at a respective, plurality of different separations with respect to one another;

a connection system; and a sling seat having opposite first and second sides and opposite first and second ends, the second end secured to the second upper cross bar of the seat frame and the first end wrappable around the first upper cross bar of the seat frame and selectively and disconnectably attachable to the second side of the sling seat at a plurality of different connection positions along the second side by the connection system, and further wherein an area of the first side arranged between the first upper cross bar and the second upper cross bar provides a seating surface; wherein the first and second cross bars are securable at each height adjustment of the plurality of different height adjustments and at a respective separation of the plurality of different separations by wrapping the first end of the sling seat around the first upper cross bar, adjusting the distance between the first and second upper cross bars to the respective separation and attaching the first end of the sling seat to the second side of the sling seat at a respective connection position of the plurality of different connection positions.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an adjustable mediation seat for allowing a meditation practitioner to progressively sit closer to the floor as the practitioner gains flexibility.

Figure 1:
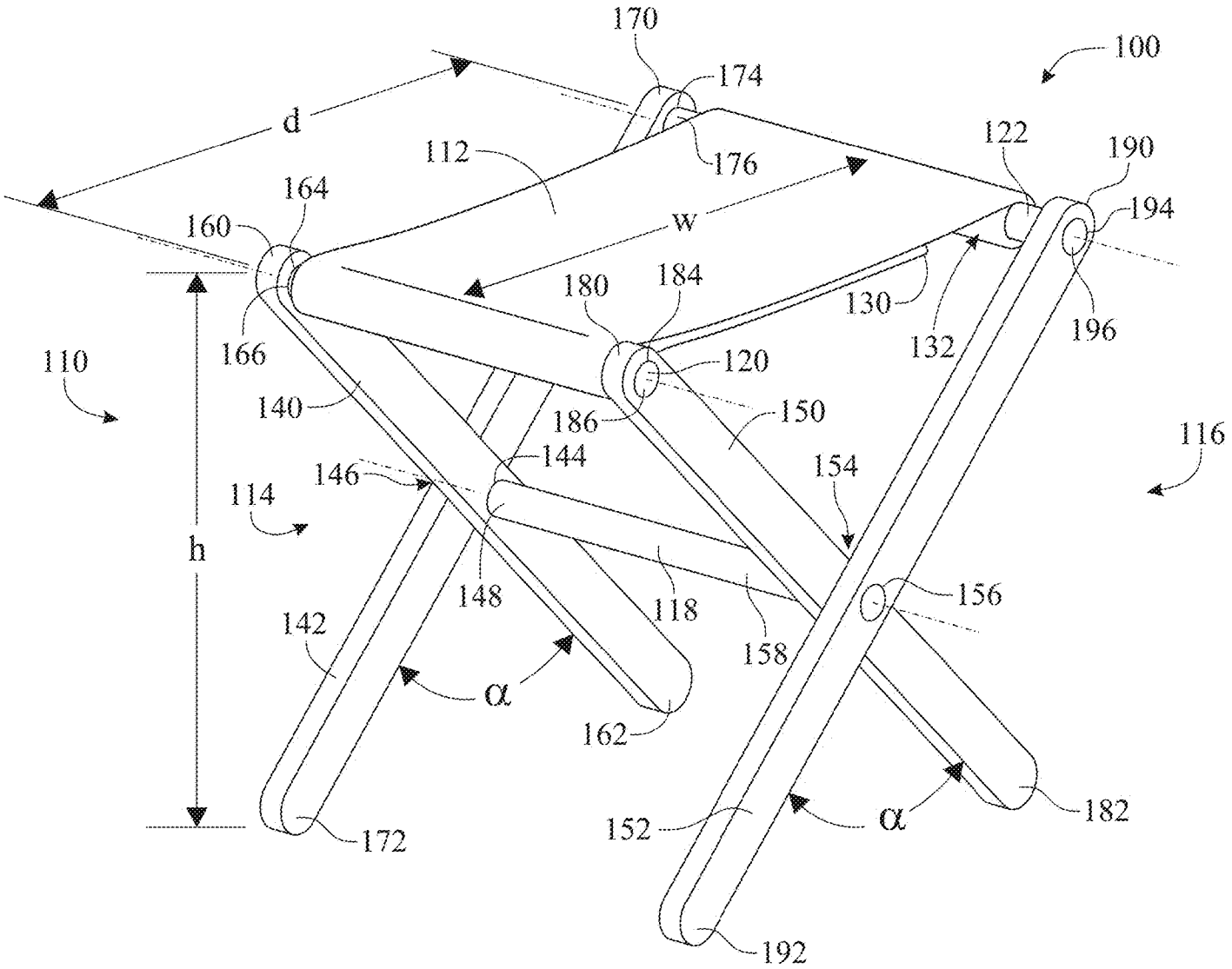
FIG. 1 presents a top, left side isometric view of an adjustable seat in accordance with a first illustrative embodiment of the present invention.
Figure 2:
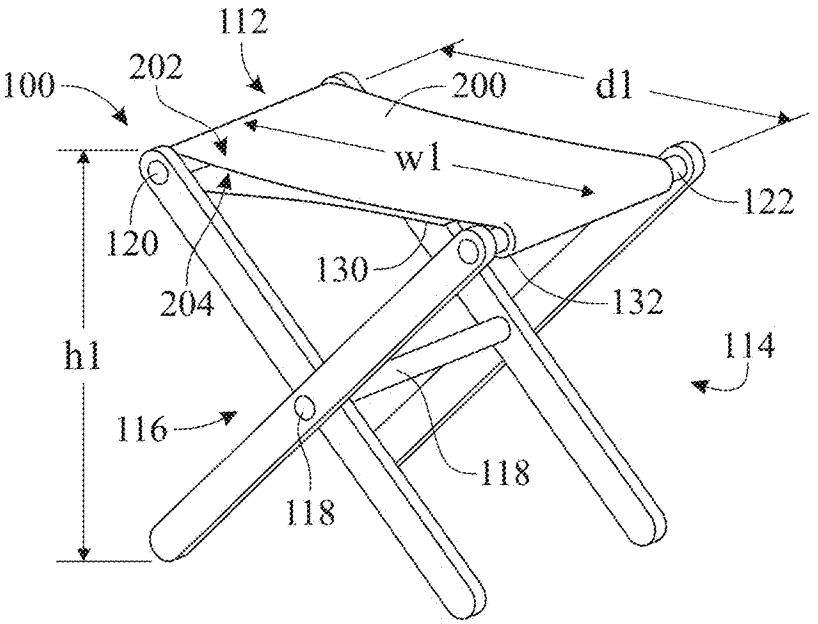
FIG. 2 presents a top, right side isometric view of the adjustable seat in a first height position with a sling seat of the adjustable seat farthest from a floor.
Figure 3:
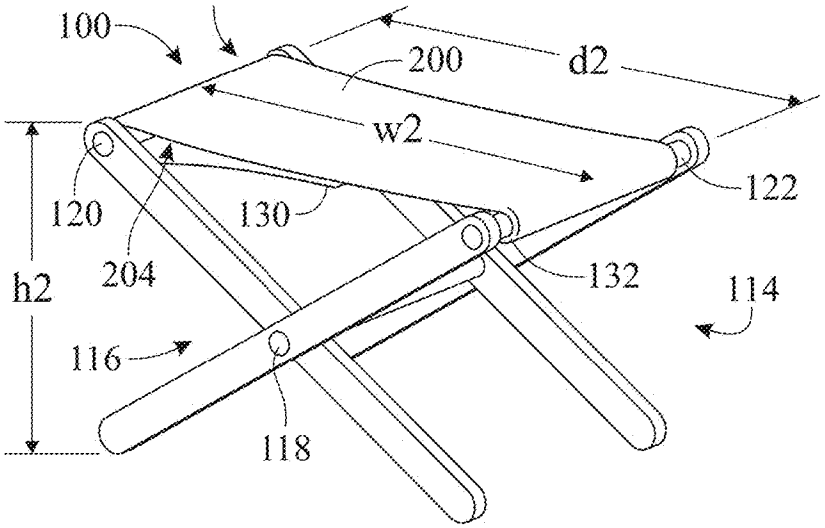
FIG. 3 presents a top, right side isometric view, similar to FIG. 2, of the adjustable seat in a second height position with the sling seat of the adjustable seat in an intermediate position with respect to the floor.

Referring initially to FIGS. 1-3, and initially to FIG. 1, an adjustable seat 100 is illustrated in accordance with an exemplary embodiment of the present invention. As shown, the adjustable seat 100 generally includes a seat frame 110 and a sling seat 112 stretched across the seat frame 110. The seat frame 110 includes a first set of adjustable crossed legs 114 and a second set of adjustable crossed legs 116 spaced apart from the first set of crossed legs 114. A first pole or center cross bar 118 extends between the first and second set of crossed legs 114 and 116, respectively.

In order to support the sling seat 112 on the seat frame 110 of the mediation seat 100, the adjustable seat 100 further includes a first upper cross bar 120 and a second upper cross bar 122. The first and second upper cross bars 120 and 122, respectively, also extend between the first and second sets of crossed legs 114 and 116, respectively.

The sling seat 112 of the adjustable seat 110 has a free, first end 130 and a fixed, second end 132. The second end 132 of the sling seat 112 is fixedly secured to the second cross bar 122 of the seat frame 110 of the adjustable seat 100. The second end 132 of the sling seat 112 can be secured to the second cross bar 122 by various means, such as, but not limited to, stapling, nailing, etc. In a preferred embodiment, the second end 132 is first wrapped around the second cross bar 122 and either secured to the second cross bar 122 or secured back upon itself by various means such as, but not limited to, sewing or stitching, gluing, welding or fusing, etc.

The sling seat 112 extends from the second cross bar 122 and is wrapped over the first cross bar 120. The first end 130 of the sling seat 112 extends back towards the second end 132 and is secured back onto the sling seat 112 at different points along the sling seat 130, in a manner described in more detail hereinbelow. By positioning the first end 130 of the sling seat 110 at various different points along the sling seat 130, the distance "d" between the first and second cross bars 120 and 122, and thus the height "h" of the adjustable seat 100 can be adjusted.

The first set of crossed legs 114 of the seat frame 110 includes a first leg 140 and second leg 142. The first leg 140 is pivotally connected to the second leg 142 about the center cross bar 118. More specifically, the first leg 140 has a central bore 144 and the second leg 142 also has a central bore 146. A first end 148 of the center cross bar 118 is mounted within the first and second central bores 144 and 146 such that the first and second legs 140 and 142, respectively, can pivot about the center cross bar 118.

Likewise, the second set of crossed legs 116 of the seat frame 110 also has a first leg 150 and a second leg 152 pivotally connected to each other about the center cross bar 118. The first leg 150 has a central bore 154 and the second leg 152 has a central bore 156. A second end 158 of the center cross bar 118 extends into the central bores 154 and 156 to pivotally connect the first and second legs 150 and 152 together.

The first leg 140 of the first set of crossed legs 114 has an upper or first end 160 and a lower or second end 162. The first end 160 of the first leg 140 has a bore 164 for receipt of a first end 166 of the first upper cross bar 120. The second leg 142 of the first set of crossed legs 114 has an upper or first end 170 and a lower or second end 172. The first end 170 of the second leg 142 has a bore 174 for receipt of a first end 176 of the second upper cross bar 122.

The first leg 150 of the second set of crossed legs 116 has an upper or first end 180 and a lower or second end 182. The first end 180 of the first leg 150 has a bore 184 for receipt of a second end 186 of the first upper cross bar 120. The second leg 152 of the second set of crossed legs 116 also has an upper or first end 190 and a lower or second end 192. The first end 190 of the second leg 152 has a bore 194 for receipt of a second end 196 of the second upper cross bar 122.

As noted hereinabove, the first and second legs 140 and 142 of the first set of crossed legs 114 and the first and second legs 150 and 152 of the second set of crossed legs 116 are pivotally connected at the center cross bar 118 and thus form a variable or adjustable angle "$\alpha$" there between. As the seat height "h" changes, the angles $\alpha$ between the first and second legs 140 and 142 of the first set of crossed legs 114 and the first and second legs 150 and 152 of the second set of crossed legs 116 change. It should be noted that the second ends 162 and 172 of the first leg 140 and second leg 142, respectively, of the first set of crossed legs 114 are rounded or otherwise smoothed out to prevent damage to floors and facilitate resting on the floor regardless of the angle α adjustment. Likewise, the second ends 182 and 192 of the first leg 150 and the second leg 152 of the second set of crossed legs 116 are similarly rounded to prevent damage to floors and facilitate resting on the floor regardless of the angle α adjustment.

The mediation seat 100 can be formed from a variety of preferably lightweight materials. For example, the seat frame 100 may be formed from wood, metal, plastic and the like. The sling seat 112 can be formed from sturdy mesh plastics, fabrics such as cotton, various leather, etc.

With continued reference to FIG. 1, the sling seat 112 of the adjustable seat 100 has an effective seating surface 200 formed by the part of an upper surface or first side 202 of the sling seat 112 extending between the first and second upper cross bars 120 and 122, respectively. The effective seating surface 200 has a width "w". In turn, the longitudinal axes of the first and second upper cross bars 120 and 122, which provide respective rotation axes for the upper ends 160, 180, 170, 190 of the first and second sets of crossed legs 114 and 116, are separated from one another a distance "d". A variation in height "h" is associated with a change in width "w" and distance "d".

More specifically, as the first and second sets of crossed legs 114 and 116 are pivoted with respect to the rotation axis defined along the center cross bar 118 to adjust the overall height of the adjustable seat 100, the distance "d" between the first and second cross bars 120 and 122 changes. As the distance "d" between the first and second cross bars 120 and 122 changes, the height "h" of the sling seat 112 and the width "w" of the seating surface 200 of the sling seat 112 change. Therefore, by lengthening and shortening the width "w" of seating surface 200 of the sling seat 112 the height "h" of sling seat 112 can be decreased and increased, respectively.

Referring now to FIG. 2, the disclosed adjustable seat 100 is illustrated at its highest position, which is also shown in FIG. 1. As shown in FIG. 2, in this highest position of the adjustable seat 100, the seating surface 200 of the sling seat 112 has a width "w" equal to "w1". The height "h" of the sling seat 112 is equal to "h1" and the distance "d" is equal to "d1".

As noted hereinabove, the second end 132 of the sling seat 112 is secured to the second upper cross bar 122. The first end 130 of the sling seat 112 is removably attached back onto a lower surface or second side 204 of the sling seat 112. By adjusting the position of the first end 130 of the sling seat 112 on the second side 204 of the sling seat 112, the width "w" of the seating surface 200 and thus the height "h" of the sling seat 112 can be adjusted. At the maximum seat height "h" or "h1" (FIG. 2), the first end 130 is at its closest position to the second upper cross bar 122 and it's farthest position from the first upper cross bar 120.

From the highest position of FIG. 2, and referring now to FIG. 3, the height "h" of the sling seat 112 can be lowered by adjusting the position and engagement of the first end 130 of the sling seat 112 on the second side 204 of the sling seat 112 to a location farther from the second upper cross bar 122 and closer to the first upper cross bar 120. As the first end 130 of the sling seat 112 is adjusted on the second side 204 of the sling seat 112, the sling seat 112 slides around the first upper cross bar 120. This effectively lengthens the width "w" of the seating surface 200 of the sling seat 112, which allows the first and second sets of cross legs 114 and 116 to pivotably open about the rotation axis defined by the center cross bar 118, thereby lowering the height "h" of the sling seat 112 for the comfort and convenience of a user or meditator. In the partially lowered position of FIG. 3, the seating surface 200 of the sling seat 112 has a width "w" equal to "w2", the height "h" of the sling seat 112 is equal to "h2", and the distance "d" is equal to "d2"; wherein "h2" is less than "h1", "d2" is greater than "d1", and "w2" is greater than "w1".

Figure 4:
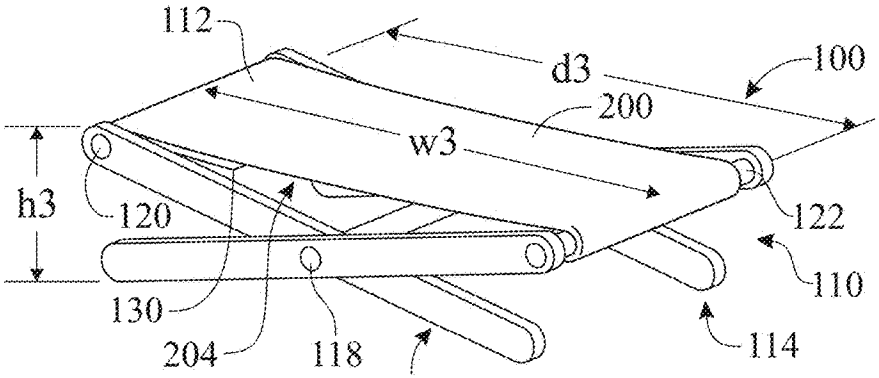
FIG. 4 presents a top, right side isometric view, similar to FIG. 3, of the adjustable seat in a third height position with the sling seat of the adjustable mediation seat closest to the floor.

With reference to FIG. 4, as the position and engagement of the first end 130 of the sling seat 112 with the second side 204 of the sling seat 112 is moved to its farthest position with regard to the second upper cross bar 122, the width "w" of the seating surface 200 of the sling seat 112 is lengthened further to lower the height "h" of the sling seat 112 of the mediation seat 100 to its lowest position as shown. In the fully lowered position of FIG. 4, the seating surface 200 of the sling seat 112 has a width "w" equal to "w3", the height "h" of the sling seat 112 is equal to "h3", and the distance "d" is equal to "d3"; wherein "h3" is less than "h2", "d3" is greater than "d2", and "w3" is greater than "w2".

It should be noted that the width "w" of the seating surface 200 can be adjusted to a number of different width values, and the height "h" of the sling seat 112 of the adjustable seat 100 can be adjusted to a corresponding number of different height values. The number of different width/height value adjustments are dependent on the number of attachment points on the second side 204 of the sling seat 112, to which the first end 130 of the seat sling 112 may be selectively attached. In some embodiments, the attachment points may be discretely provided at the second side 204, and the number of attachment points may be any number greater than one. In other embodiments, the attachment points may be generally continuous along the second side 204.

Figure 5:
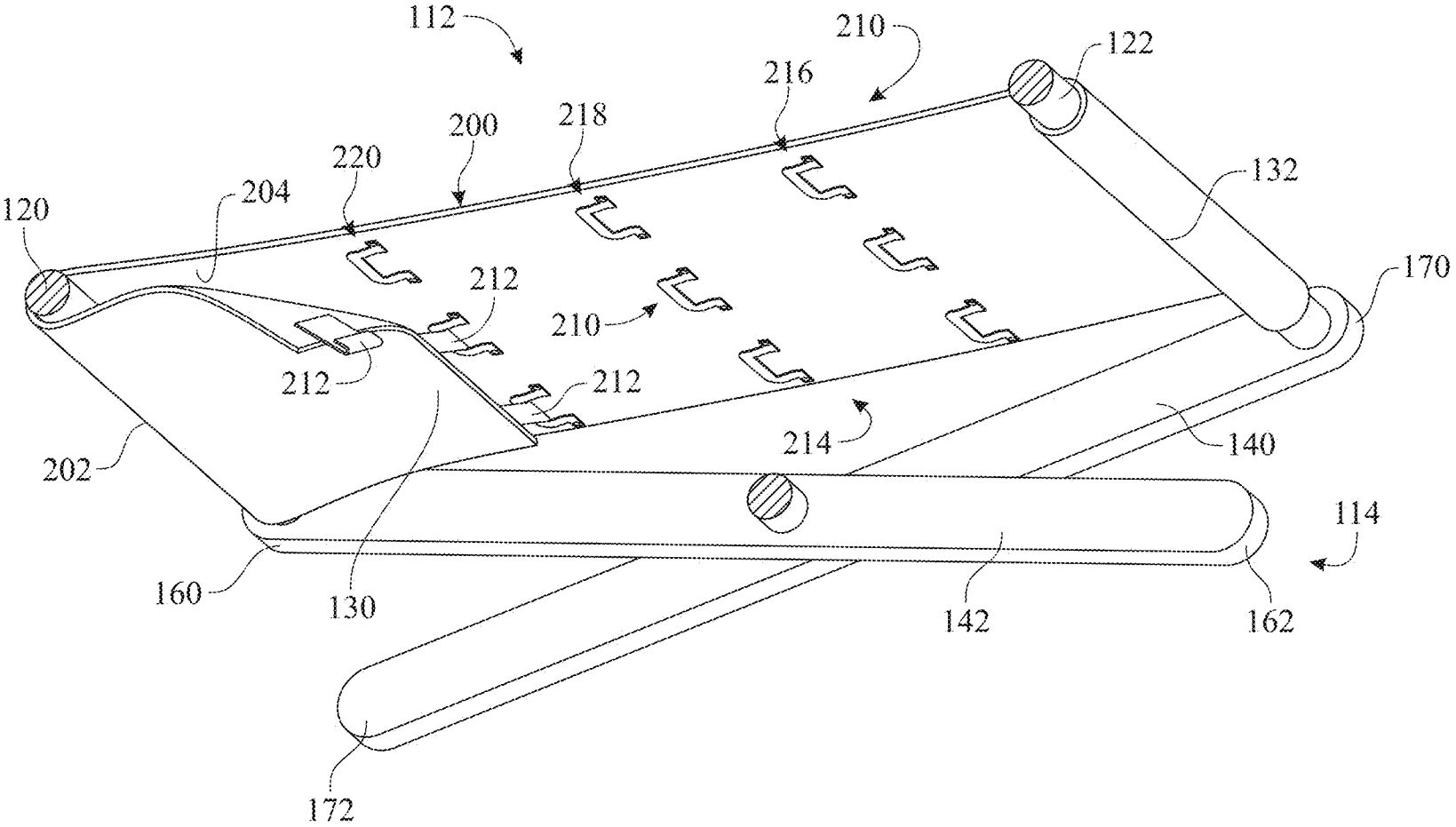
FIG. 5 presents a bottom isometric view, with parts removed, of the adjustable seat of FIG. 1.

Turning now to FIG. 5, in a first example of a set of discrete attachment points, in order to secure the first end 130 of the sling seat 112 to the second side 204 of the sling seat 112, the adjustable seat 100 includes a connection or hook system 210 attached to the sling seat 112. The hook system 210 includes a series of hooks 212 attached to the free first end 130 of the sling seat 112 and a plurality of anchors 214 attached to the second side 204 of the sling seat 112. The number and location of the plurality of anchors 214 may vary and provide the ability to adjust the height "h" of the sling seat 112 (FIG. 1).

In the illustrated embodiment, the hook system 210 includes a plurality of rows of anchors 214 spread across the second side 204 of the sling seat 112. The plurality of rows of anchors 214 includes a first row of anchors 216, a second row of anchors 218 and a third row of anchors 220 affixed to the second side 204 of the sling seat 112. The hooks 212 are selectively and releasably engageable with each row of anchors 214, 216, 218 of the plurality of rows of anchors 214. For example, to adjust the sling seat 112 to the highest position (FIG. 2), the hooks 212 of the hook system 210 are engaged with the first row of anchors 216. As noted above, the sling seat 112 slides around the first upper cross bar 120 as the first end 130 of the sling seat 112 is drawn towards the second upper cross bar 122. The first row of anchors 216 are closest to the second upper cross bar 122. Thus, positioning the hooks 212 in the first row of anchors 216 shortens the width "w" of the seating surface 200 of the sling seat 112 to its lowest value "w1" (FIG. 2) to set the height "h" of the adjustable seat 100 to the highest value "h1".

By instead engaging the hooks 212 with the third row of anchors 220, the width "w" of the seating surface 200 is lengthened (FIG. 4) to its maximum value "w3" thereby setting the adjustable seat 100 to its lowest position. In turn, securing the hooks 212 to the second row of anchors 218 allows to configure the width "w" of the seating surface 200 is to an intermediate value "w2" (FIG. 3) setting the adjustable seat 100 at an intermediate height "h2".

Figure 6:
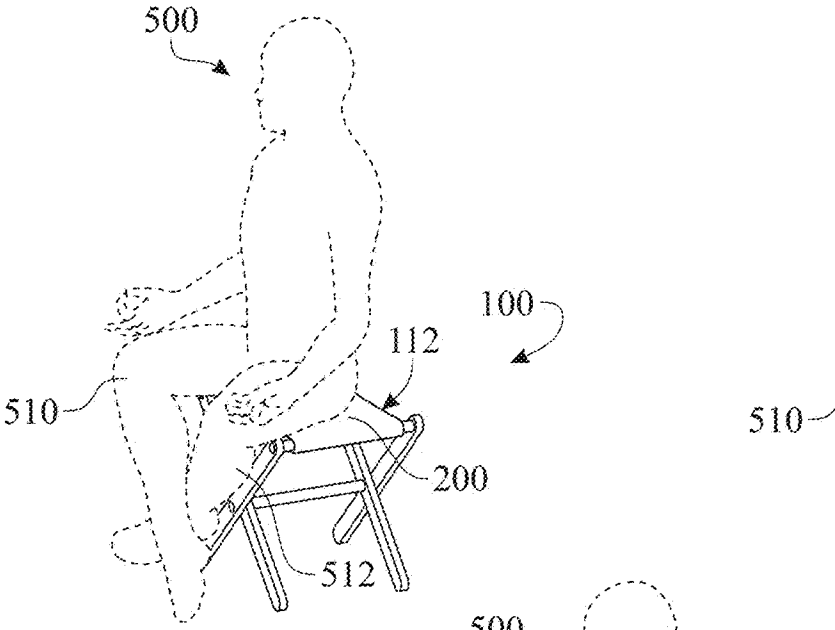
FIG. 6 presents an isometric view of the adjustable seat of FIG. 1 in the first position with a meditator sitting on the adjustable seat.

Referring now to FIGS. 6-9, and initially with regard to FIG. 6, the adjustable seat 100 is provided for use by a person or meditator, such as a meditator 500, to comfortably engage in meditation and to allow the meditator 500 to progress from an upright seated position on the adjustable seat 100 to a seated position on a floor or pillow as the meditator 500 gains flexibility. As shown in FIG. 6, the adjustable seat 100 is adjusted to the highest position (also shown in FIG. 2) by adjusting the hook system 210 as described hereinabove and the meditator 500 is comfortably seated on the seating surface 200 of the sling seat 112 with legs 510 and 512 of the meditator 500 in a fairly straight crossed condition. This position of the adjustable seat 100 is for beginners or others suffering from injury. The height "h1" (FIG. 2) of the sling seat 112 in this highest position may be about one foot above the ground.

Figure 7:
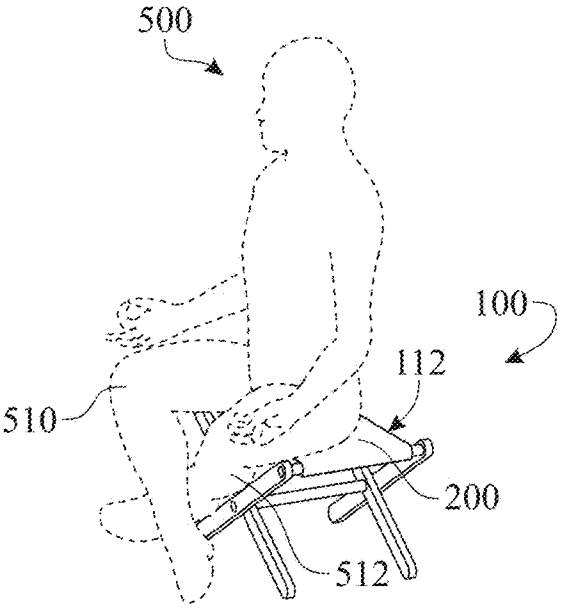
FIG. 7 presents an isometric view of the adjustable seat of FIG. 1 in the second position with the meditator sitting on the adjustable seat.

Referring to FIG. 7, as the meditator 500 gains some flexibility in the legs 510 and 512, the adjustable seat 100 can be lowered by adjusting the hook system 210 of the adjustable seat 100 to the intermediate position (also shown in FIG. 3). The meditator 500 can then sit on the seating surface 200 of the sling seat 112 with the legs 510 and 512 slightly more crossed. In this position, the height "h2" (FIG. 3) of the sling seat 112 may be about 10 inches from the floor.

Figure 8:
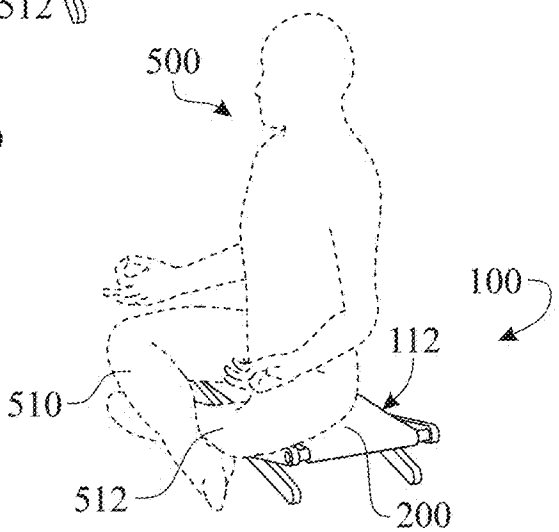
FIG. 8 presents an presents an isometric view of the adjustable seat of FIG. 1 in the third position with the meditator sitting on the adjustable seat.
Figure 9:
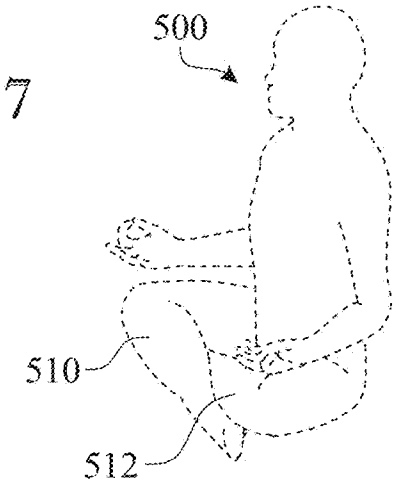
FIG. 9 presents an isometric view of the meditation sitting without use of the adjustable seat of FIG. 1.

As shown in FIG. 8, when the meditator 500 gains further flexibility, the adjustable seat 100 can be lowered to its lowest position (also shown in FIG. 4) positioning the meditator 500 fairly close to the floor and with the legs 510 and 512 at a very shallow angle. In this position, the height "h2" (FIG. 4) of the sling seat 112 may be approximately about 4-5 inches from the floor. The ultimate goal is to progressively allow the meditator 500 to gain sufficient flexibility to actually sit directly on the floor (FIG. 9). Thus, the adjustable seat 100 can be adjusted to accommodate a wide variety of meditators 500 having varying degrees of flexibility as well as allowing a single meditator 500 to sit progressively closer to the floor as the meditator gains in flexibility.

Figure 10:
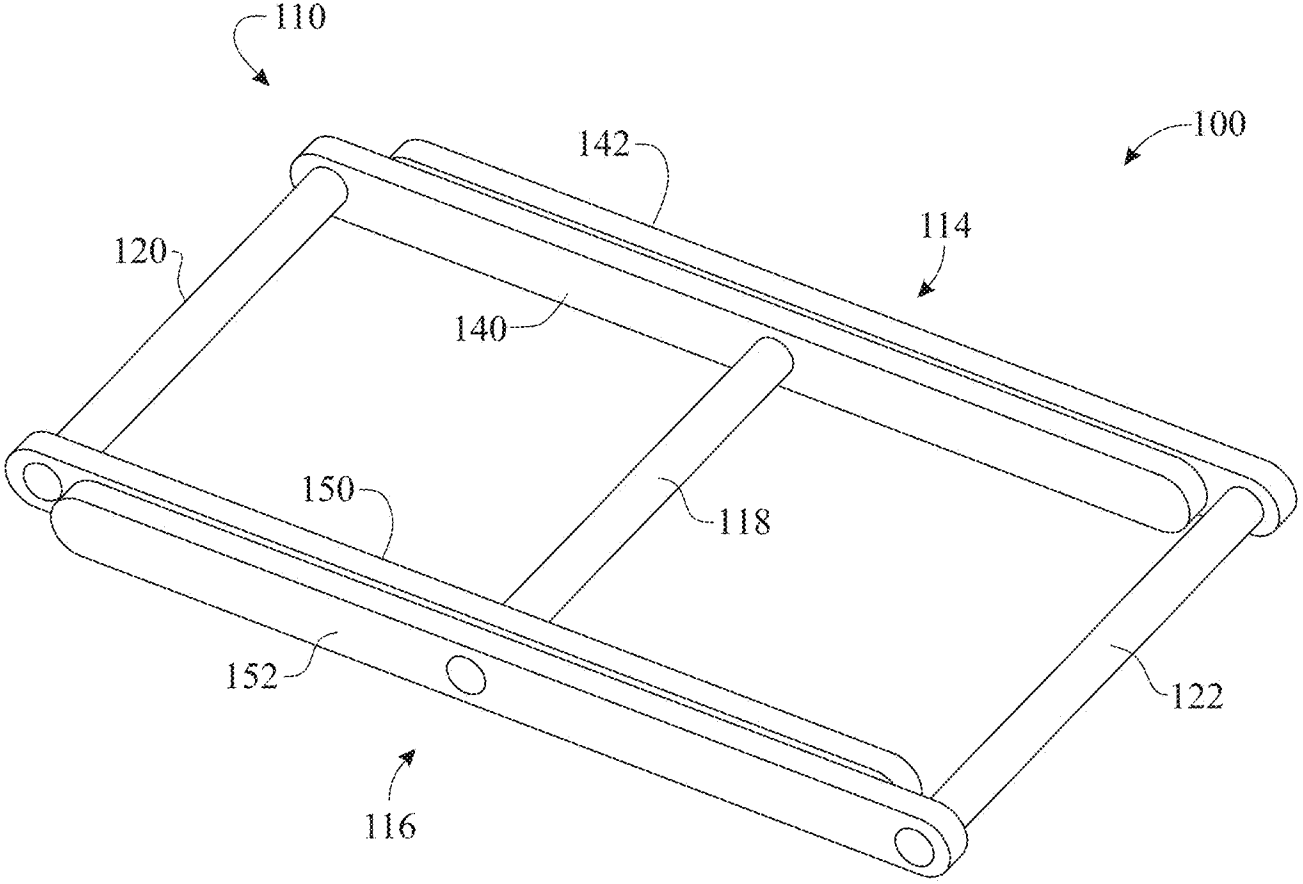
FIG. 10 presents an isometric view of the adjustable seat of FIG. 1 with the sling seat disengaged from itself and the seat frame folded for storage.

Turning for the moment to FIG. 10, when the adjustable seat 100 is not in use, meditator 500 can adjust the adjustable seat 100 to a flat or storage position. By entirely disengaging the hooks 212 of the hook system 210 of the adjustable seat 100 from the anchors 214 (FIG. 5) the sling seat 112 is released from itself. The seat frame 110 and, in particular the first and second sets of crossed legs 114 and 116, respectively, of the seat frame 110, can then be pivoted about the center cross bar 118 to a fully flat condition for storage, in which the first and second legs 140, 142, 150, 152 are generally parallel to one another, as shown.

Figure 12:
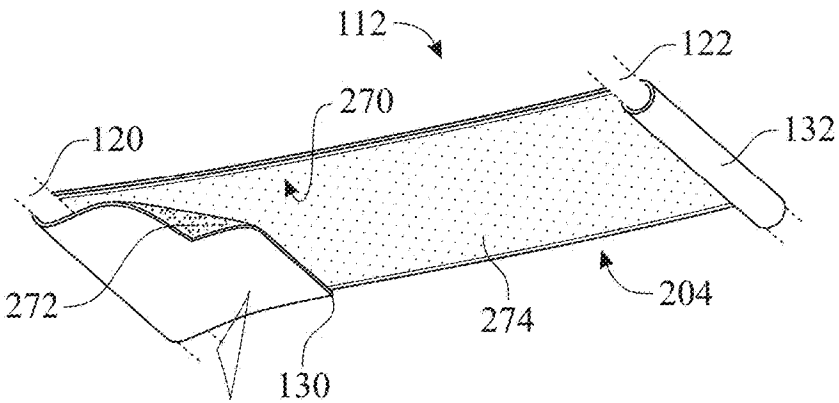
FIG. 12 presents a bottom isometric view of a second embodiment of a seat sling for use with the seat frame of FIG. 1.
Figure 11:
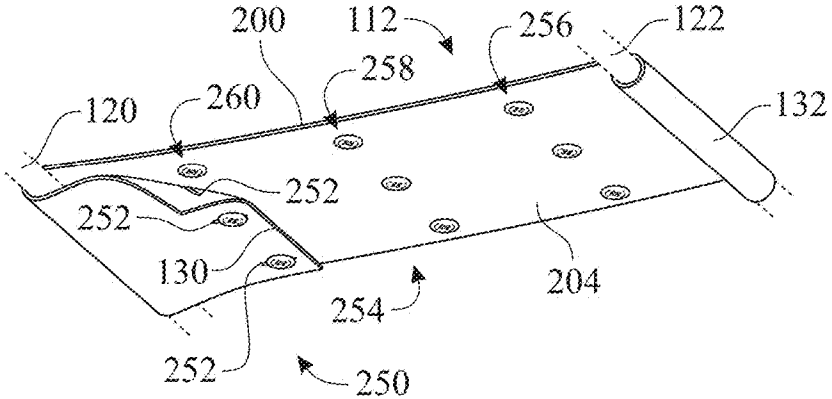
FIG. 11 presents a bottom isometric view of a first embodiment of a seat sling for use with the seat frame of FIG. 1.
Figure 13:
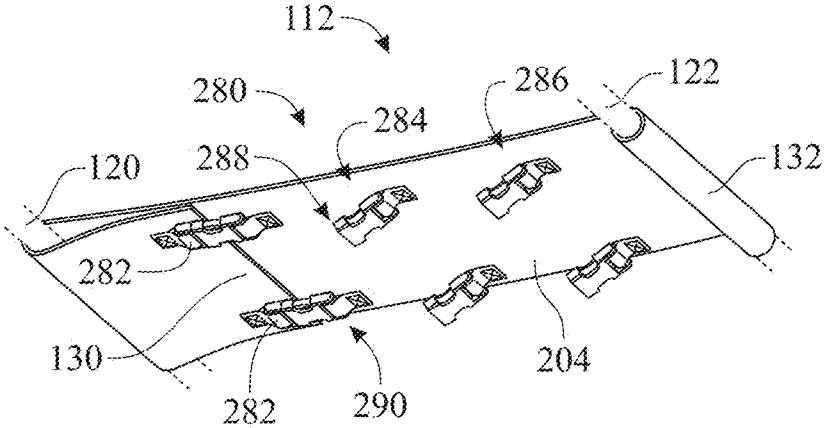
FIG. 13 presents a bottom isometric view of a third embodiment of a seat sling for use with the seat frame of FIG. 1.

With reference to FIGS. 11-13, there are disclosed alternative devices for connecting the first end 130 of the sling seat 112 to the second side 204 of the sling seat 112 to adjust the height of the adjustable seat 100. Referring to FIG. 11, a connection or button system 250 may be used to connect the first end 130 of the sling seat 112 to the second side 204 of the sling seat 112. The button system 250 generally includes a series of slots 252 cut into the first end 130 of the sling seat 112 and a plurality of rows of buttons 254 affixed to the second side 204 of the sling seat 112. The plurality of rows of buttons 254 includes a first row of buttons 256, a second row of buttons 258 and a third row of buttons 260. By selectively positioning the first, second or third row of buttons 256, 258 or 260, respectively, on the second side 204 of the sling seat in the series of slots 252 in the first end 130 of sling seat 112, the distance "d" (FIG. 1) between the first and second cross bars 120 and 122, and thus the height "h" (FIG. 1) of the sling seat 112 can be adjusted.

An alternative connection device for adjusting the height "h" of the sling seat 112 of the adjustable seat 100 is disclosed in FIG. 12. In this embodiment, the connection device is in the form of a hook-and-loop fastener closure system 270 and allows for a generally continuous height adjustment. The hook-and-loop fastener or closure system 270 generally includes hook material or hooks 272 and loop material or loops 274 formed on or attached to the second side 240 of the sling seat 112. Since the sling seat 112 is wrapped around the first upper cross bar 120, both the hooks 272 and loops 274 are on the same side, namely the second side 204, of the sling seat 112. A commercial version of the disclosed hook-and-loop fastener system 270 is commonly marketed under the name Velcro®. The use of the hook-and-loop fastener system 270 allows for a progressive amount of engagement positions of the hooks 272 with the loops 274. This provides the meditator 500 with the ability to adjust the height "h" of the sling seat 112 of the mediation seat 100 in a continuous or fully variable amount to set the seat height "h" at exactly the right height.

In a further alternative embodiment of a connection device shown in FIG. 13, a connection device in the form of a buckle system 280 is used to secure the first end 130 of the sling seat 112 to the second side 204 of the sling seat 112 to adjust the height "h" of the sling seat 112. Specifically, male ends 282 of the buckle system 280 are attached to the first end 130 of the sling seat 112 and female ends 284 are connected to the second side 204 of the sling seat 112. In the disclosed embodiment, the buckle system 280 includes three rows of female ends 284 including first row 286, a second row 288 and a third row 290. By selectively connecting the male ends 282 of the buckle system 280 with specific rows of female ends 284 of the buckle system 280, the height "h" of the sling seat 112 of the adjustable seat 100 can be adjusted. One such commercially available bucket system is commonly marketed as a Fastex® system.

Thus, the disclosed adjustable seat 100 provides a novel device for allowing a meditator or user to adjust the height of the adjustable seat 100 to a comfortable seated meditation position while allowing the meditator to lower the height as flexibility is increases. Additionally, the height of the adjustable seat 100 can be raised to accommodate a meditator who has temporarily or permanently lost some flexibility in the legs due to injury, medical issues, and the like.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An adjustable seat, allowing a user to sit closer to a floor as the user gains flexibility or to otherwise adjust a seating distance of the user with respect to the floor, the adjustable seat comprising:

a seat frame comprising a first upper cross bar and a second upper cross bar arranged in parallel and spaced-apart relationship with one another, wherein the seat frame is adjustable such that the first upper cross bar and the second upper cross bar are selectively positionable in a plurality of different height adjustments with respect to the floor and at which the first and second upper cross bars are arranged at a respective, plurality of different separations with respect to one another;

a connection system; and a sling seat having opposite first and second sides and opposite first and second ends, the second end secured to the second upper cross bar of the seat frame and the first end wrappable around the first upper cross bar of the seat frame and selectively and disconnectably attachable to the second side of the sling seat at a plurality of different connection positions along the second side by the connection system, and further wherein an area of the first side arranged between the first upper cross bar and the second upper cross bar provides a seating surface; wherein the first and second cross bars are securable at each height adjustment of the plurality of different height adjustments and at a respective separation of the plurality of different separations by wrapping the first end of the sling seat around the first upper cross bar, adjusting the distance between the first and second upper cross bars to the respective separation and attaching the first end of the sling seat to the second side of the sling seat at a respective connection position of the plurality of different connection positions.

2. The adjustable seat of claim 1, wherein the second end of the sling seat is permanently secured to the second upper cross bar.

3. The adjustable seat of claim 1, wherein the seat frame further comprises first and second sets of crossed legs, the first set of crossed legs comprising first and second legs pivotably connected to one another about a rotation axis, the second set of crossed legs comprising first and second legs pivotably connected to one another about the rotation axis, wherein the first upper cross bar extends between the first legs of the first and second sets of crossed legs and the second upper cross bar extends between the second legs of the first and second sets of crossed legs, and further wherein the first upper cross bar and the second upper cross bar are selectively positionable in the plurality of different height adjustments by pivoting the first and second legs of the first set of crossed legs and the first and second legs of the second set of crossed legs about the rotation axis.

4. The adjustable seat of claim 3, wherein the seat frame further comprises a center cross bar extending between the first and second sets of crossed legs and defining the rotation axis.

5. The adjustable seat of claim 3, wherein the first cross bar extends between an upper end of the first leg of the first set of crossed legs and an upper end of the first leg of the second set of crossed legs.

6. The adjustable seat of claim 3, wherein the second cross bar extends between an upper end of the second leg of the first set of crossed legs and an upper end of the second leg of the second set of crossed legs.

7. The adjustable seat of claim 3, wherein a respective, lower end of each one of the first and second legs of each one of the first and second sets of crossed legs is rounded.

8. The adjustable seat of claim 3, wherein the seat frame is collapsible to a generally planar configuration in which the first and second legs of the first and second sets of crossed legs are pivotally arranged in parallel relationship with one another.

9. The adjustable seat of claim 1, wherein the connection system comprises a hook-and-loop fastener system.

10. The adjustable seat of claim 1, wherein the plurality of different connection positions consists of a set of discrete connection positions.

11. The adjustable seat of claim 10, wherein the connection system comprises a plurality of fastener members connected to the second side of the sling seat and at least one fastener member connected to the first end of the sling seat, the at least one fastener member on the first end of the sling seat and configured to disconnectably attach to the plurality of fastener members of the second side of the sling seat.

12. The adjustable seat of claim 11, wherein the plurality of fastener members comprises at least two rows of fastener members, wherein each row of the at least two rows is arranged at a respective, different distance from the first upper cross bar and defines a respective connection position of the plurality of different connection positions, and further wherein the at least one fastener member on the first end of the sling seat comprises a row of fastener members, the row of fastener members selectively attachable to each row of the at least two rows of fastener members.

13. The adjustable seat of claim 11, wherein the plurality of fastener members connected to the second side of the sling seat comprises a plurality of anchors, and the at least one fastener member on the first end of the sling seat comprises at least one hook configured to disconnectably attach to the plurality of anchors.

14. The adjustable seat of claim 11, wherein the plurality of fastener members connected to the second side of the sling seat comprises a plurality of buttons, and the at least one fastener member on the first end of the sling seat comprises at least one slot configured to disconnectably engage the plurality of buttons.

15. The adjustable seat of claim 11, wherein the plurality of fastener members connected to the second side of the sling seat comprises a plurality of first buckle members, and the at least one fastener member on the first end of the sling seat comprises at least second buckle member configured to disconnectably engage the plurality of first buckle members.

16. The adjustable seat of claim 1, wherein, in a highest height adjustment of the plurality of different height adjustments of the first and second upper cross bars, the seating surface may be arranged at about 1 foot from the floor.

17. The adjustable seat of claim 1, wherein, in an intermediate height adjustment of the plurality of different height adjustments of the first and second upper cross bars, the seating surface may be arranged at about 10 inches from the floor.

18. The adjustable seat of claim 1, wherein, in a lowest height adjustment of the plurality of different height adjustments of the first and second upper cross bars, the seating surface may be arranged at about 4 to 5 inches from the floor.

19. An adjustable seat, allowing a user to sit closer to a floor as the user gains flexibility or to otherwise adjust a seating distance of the user with respect to the floor, the adjustable seat comprising:

a seat frame comprising:

first and second sets of crossed legs, the first set of crossed legs comprising first and second legs pivotably connected to one another about a rotation axis, the second set of crossed legs comprising first and second legs pivotably connected to one another about the rotation axis, and a first upper cross bar and a second upper cross bar arranged in parallel and spaced-apart relationship with one another, wherein the first upper cross bar extends between the first legs of the first and second sets of crossed legs and the second upper cross bar extends between the second legs of the first and second sets of crossed legs, wherein the first upper cross bar and the second upper cross bar are selectively positionable in a plurality of different height adjustments with respect to the floor by pivoting the first and second legs of the first set of crossed legs and the first and second legs of the second set of crossed legs about the rotation axis, wherein, at said plurality of different height adjustments of the first and second upper cross bars the first and second upper cross bars are arranged at a respective, plurality of different separations with respect to one another;

a connection system; and a sling seat having opposite first and second sides and opposite first and second ends, the second end permanently secured to the second upper cross bar of the seat frame and the first end wrappable around the first upper cross bar of the seat frame and selectively and disconnectably attachable to the second side of the sling seat at a plurality of different connection positions along the second side by the connection system, and further wherein an area of the first side arranged between the first upper cross bar and the second upper cross bar provides a seating surface; wherein the first and second cross bars are securable at each height adjustment of the plurality of different height adjustments and at a respective separation of the plurality of different separations by wrapping the first end of the sling seat around the first upper cross bar, adjusting the distance between the first and second upper cross bars to the respective separation and attaching the first end of the sling seat to the second side of the sling seat at a respective connection position of the plurality of different connection positions.

20. An adjustable seat, allowing a user to sit closer to a floor as the user gains flexibility or to otherwise adjust a seating distance of the user with respect to the floor, the adjustable seat comprising:

a seat frame comprising:

first and second sets of crossed legs, the first set of crossed legs comprising first and second legs pivotably connected to one another about a rotation axis, the second set of crossed legs comprising first and second legs pivotably connected to one another about the rotation axis, and a first upper cross bar and a second upper cross bar arranged in parallel and spaced-apart relationship with one another, wherein the first upper cross bar extends between upper ends of the first legs of the first and second sets of crossed legs and the second upper cross bar extends between upper ends of the second legs of the first and second sets of crossed legs, wherein the first upper cross bar and the second upper cross bar are selectively positionable in a plurality of different height adjustments with respect to the floor by pivoting the first and second legs of the first set of crossed legs and the first and second legs of the second set of crossed legs about the rotation axis, wherein, at said plurality of different height adjustments of the first and second upper cross bars the first and second upper cross bars are arranged at a respective, plurality of different separations with respect to one another;

a connection system; and a sling seat having opposite first and second sides and opposite first and second ends, the second end permanently secured to the second upper cross bar of the seat frame and the first end wrappable around the first upper cross bar of the seat frame and selectively and disconnectably attachable to the second side of the sling seat at a plurality of different connection positions along the second side by the connection system, and further wherein an area of the first side arranged between the first upper cross bar and the second upper cross bar provides a seating surface; wherein the first and second cross bars are securable at each height adjustment of the plurality of different height adjustments and at a respective separation of the plurality of different separations by wrapping the first end of the sling seat around the first upper cross bar, adjusting the distance between the first and second upper cross bars to the respective separation and attaching the first end of the sling seat to the second side of the sling seat at a respective connection position of the plurality of different connection positions.

* * * * *